US005615879A

United States Patent [19]

Bailey

[11] Patent Number: 5,615,879

[45] Date of Patent: Apr. 1, 1997

[54] BATTING PRACTICE AID AND METHOD OF USING SAME

[76] Inventor: Peter M. Bailey, 3518 Mission Blvd., San Diego, Calif. 92109

[21] Appl. No.: 517,555

[22] Filed: Aug. 21, 1995

[51] Int. Cl.[6] ..... A63B 69/40

[52] U.S. Cl. ..... 473/424

[58] Field of Search ..... 273/26 E, 58 C, 273/200 A, 200 B, 200 C, 184 B, 185 C, 413

[56] References Cited

U.S. PATENT DOCUMENTS

| | | | |
|---|---|---|---|
| 2,213,570 | 9/1940 | Rohland | 273/200 B |
| 2,842,366 | 7/1958 | Fant | 273/26 E |
| 2,942,883 | 6/1960 | Moore | 273/26 E |
| 3,214,166 | 10/1965 | Gaudet | 273/26 E |
| 3,637,209 | 1/1972 | Rant | 273/26 E |
| 3,907,287 | 9/1975 | Fox | 273/26 E |
| 3,934,873 | 1/1976 | Griffin | 273/26 E |
| 4,186,921 | 2/1980 | Fox | 273/26 E |
| 4,415,155 | 11/1983 | Goudreau | 273/26 E |

*Primary Examiner*—Theatrice Brown
*Attorney, Agent, or Firm*—Gilliam, Duncan and Harms

[57] ABSTRACT

The batting practice aid includes a single handle, which is sized to be grasped by a single hand of a user, is connected to one end of an impact absorbing line having a soft rubber ball connected to its other end. The line is resistably stretchable along its entire length to permit it to absorb sudden tension forces suddenly applied to the line, wherein the resistance to stretching of the line increases as the amount of stretch of the line increases. The ball is rotated in a circular pattern about the handle by the user. The ball is spaced apart from the handle by a critical safe distance of between about six feet and about 11½ feet to enable the aid to be used in a safe and yet controlled manner according to the inventive method.

2 Claims, 1 Drawing Sheet

BATTING PRACTICE AID AND METHOD OF USING SAME

TECHNICAL FIELD

The present invention relates in general to an improved batting practice aid and a method of using it. The invention more particularly relates to a batting practice aid which may be used to develop ball batting skills, and which can be used according to a novel method.

BACKGROUND ART

Sports, such as baseball and softball, involve the use of a bat for striking a moving ball. Generally, a thrower or pitcher propels the relatively small ball towards a batter holding the relatively small bat. The batter has an associated "strike zone" and is required to swing the bat and hit the ball when the ball thrown into the strike zone or be penalized in the form of a "strike."

To enable the batter to contact the moving ball, the batter must develop hand and eye coordination skills. The hand and eye coordination skills permit the batter to determine when and where to swing the bat according to the speed and flight path of the oncoming ball.

Proficiency in batting oftentimes requires the batter to spend a substantial amount of time developing the hand and eye coordination skills required to hit the ball with the bat, at various speeds and trajectories of the ball. In the past, during batting practice, it has been necessary for the batting practice thrower, positioned in front of and a good distance away from the batter, to hurl the ball towards the strike zone. While this conventional approach enables the batter to practice hitting the ball, it was unduly burdensome in certain circumstances in that such a batting practice approach requires at least three players: the batter, the pitcher, and a third person to retrieve the ball. Also, the pitcher must possess adequate skills to repeatedly throw the ball at or near the strike zone.

To reduce the number of players necessary to practice batting skills and also to better enable the batter to adjust or correct his or her swing, a batting tee was introduced. The batting tee included an upstanding post and a recess at the top of the post to support the ball. The height of the post was adjusted to approximate the strike zone of the batter.

By striking at the ball atop the post, the batter was able to practice swinging and striking the stationary ball to develop hand and eye coordination skills, and to adjust or correct his or her swing of the bat. Thus, the need for a batting practice pitcher was eliminated. However, the requirement for another person to retrieve the struck ball remains.

Batting tees have also employed a line connected at one of its ends to the post and fixed at its other end to the ball. The line permitted the stationary ball to be struck, and yet the line limited the distance that the ball could travel. As a result, the batter could easily retrieve the ball without the aid of others.

Thus, batting tees enable batters to practice alone. However, the batter was still required to retrieve a ball that had been struck. Thus, an inordinately large amount of time was spent by the batter retrieving the ball and replacing it onto the tee. Thus, practice time was lost.

The introduction of a batting cage marketed under the trademark "SOLOHITTER", by Sports Lab USA of San Diego, Calif., enables a batter to practice batting a stationary ball without the need for other persons to assist. Furthermore, the need to retrieve a ball which had been struck was eliminated.

The SOLOHITTER batting cage included a large frame structure supporting a ball receiving net and three rubber lines supporting a ball in front of the frame to help support the ball in a stationary position at a desired ball hitting height.

The batter could use the device to practice batting skills without spending time retrieving balls. In this regard, the batter could swing at the stationary ball and hit it into the net. The net and the three lines cooperate to absorb the energy imparted to the ball, and eventually return the ball to its original stationary position.

Although the SOLOHITTER™ enabled a batter to practice without retrieving balls that had been hit, the device is very expensive and not accessible for a large number of persons. Furthermore, the device did not provide hand and eye coordination skills relative to a moving ball, such as would be confronted by a batter in an actual game environment.

To provide practice for a batter to develop hand and eye coordination for striking a moving ball, a ball batting aid was introduced by K-Bear Athletics, Inc. of St. Joseph, Mich. The ball batting aid was intended for use by two people, a batter and a holder or user. The batting aid included a pair of spaced apart handles connected at one end to a rope, and a hard rubber ball is secured to the other end of the rope. The distance between the handle end and the ball was approximately 16 feet. U.S. Pat. No. 4,702,866 describes a method of securing the ball to the rope, and is incorporated by reference as if fully set forth herein.

The batting aid was used by having the user stand about sixteen feet away from the batter. The batting aid user would grasp the handles with both hands spaced apart from one another to enable the handle to be firmly grasped. The handles would then be manipulated with both of the hands of the holder to cause the ball to move in a circle about the handle above the head of the user. By controlling the flight of the ball, the user could direct the ball toward the strike zone of the batter to enable the batter to attempt to strike the moving ball, and thereby cause it to move in a reverse direction along a similar circular path of travel about the user. The user could then stop the ball, and repeat the operation.

Even though the batting aid enabled a batter to practice with a moving ball, the batting aid had a number of drawbacks. For example, the user was susceptible to injuries inflicted by the batter striking, or attempting to strike the moving ball. In this regard, the sudden impact of the bat on the ball, or the rope if the ball was missed, was transmitted by the rope to the handles. Thus, the hands and arms of the user could be injured by the sudden jerking motion when the ball on the rope was hit by the bat.

Similarly, the batter could be injured if the batter missed the ball and contacted the rope instead. In this situation, the hitting of the rope could abruptly interfere with the swing of the bat by the batter. This unexpected jerking of the bat could lead to injuries to the hands and upper body of the batter.

In addition to the drawbacks related to injuries, the batting aid was very difficult to control. The operation of the batting aid by the user required a large amount of physical strength and agility to make the ball circle about the handles at a desirable speed. The holder also had to possess the necessary strength to continue to rotate the ball for a sustained period of time, because the batter would not swing at the ball every time that it came around, even if the ball was within the strike zone. Continuously rotating the ball would drain the upper body strength of the holder, tiring out the arms of the holder. As a result, the batting aid was difficult if not impossible for a young person that did not have a great deal of upper body strength to operate the batting aid.

Due to the small size of the strike zone, the user has had great difficulty in attempting to control the ball so that the path of travel of the ball included the strike zone of the batter. In this regard, the user had to hold securely the two handles in preparation for a sudden impact on the ball or the rope, and yet be able to swing the ball over the head of the user and downwardly toward and through the strike zone. The movement of the ball had to be controlled in such a manner that the ball would continue to travel repeatedly through the circular path of travel until the batter struck and hit the moving ball with a bat.

Such an operation requires a great deal of skill to continue effectively, without tiring. Such operation is difficult, if not impossible, to accomplish for younger or smaller people.

A batting practice device for swinging a ball by a user in an orbit is disclosed in U.S. Pat. No. 5,238,241, which is incorporated by reference as if fully set forth herein. The disclosed batting practice device includes a tether assembly having a handle and a first inelastic segment of cord coupled to the handle at two places. A second inelastic segment of cord is connected at one end to a ball. The free end of the first segment is coupled to the free end of the second segment by a continuous elastic band. A third inelastic segment of cord is connected between the two free ends to reduce the possibility of over extension and rupture of elastic band.

Although the tether assembly provides some stretch for safety purposes, the tether assembly can be stretched quite easily. Once stretched to the limit, the tether assembly is suddenly and instantly prevented from stretching further by the third inelastic segment. Thus, the batter and the user would first experience a slight resistance to a blow to the tether assembly, and then be suddenly jerked as the tether assembly reached its stretching capacity.

The disclosed handle is similar to tow rope handles used for water skiing. In this regard, the handle is secured at its top and bottom to the first inelastic segment to form a triangular opening to receive the fingers of the user. As a result, the user must exert unnecessary energy in order to rotate the ball in the desired orbit.

Due to the handle configuration, the wrist of the user involved in rotating the ball must be rotated itself to prevent the first inelastic segment from wrapping around the hand of the user holding the handle. Alternatively, the body of the user must be rotated simultaneously with the ball. In either case, the additional energy exerted by the user to cause the ball to rotate without wrapping around the user's hand will unnecessarily reduce the amount of time that the user can continue to rotate the ball. Furthermore, the chance of injury to the user is increased due to the unnatural contortions that are required of the user.

Therefore, it would be highly desirable to have a new and improved batting practice aid which permits a ball to be delivered to the strike zone of a batter and permits the ball to be retrieved easily. Such a batting practice aid should protect the users from injury and should enable a variety of people to use the batting practice aid, including younger or smaller people having relatively little upper body strength.

DISCLOSURE OF INVENTION

Therefore, the principal object of the present invention is to provide a new and improved batting practice aid, and a method of using it, wherein the aid facilitates the delivery of a moving ball by the user to the strike zone of a batter repeatedly and under the control of the user.

Such an aid and method should also enable the ball to be retrieved easily, should protect users from injury, and should enable a variety of people to use the batting practice aid, including younger or smaller people having relatively little upper body strength.

Briefly, the above and further objects of the present invention are realized by providing a new and improved batting practice aid, and a method of using it, wherein the aid delivers a moving ball to the strike zone of a batter, enables the ball to be retrieved easily, protects users from injury and enables a variety of people to use the batting practice aid, including younger or smaller people having relatively little upper body strength.

The batting practice aid includes a single handle, which is sized to be grasped by a single hand of a user, and is connected to one end of an impact absorbing line having a soft rubber ball connected to its other end. The line is resistably stretchable along its entire length to permit it to absorb sudden tension forces suddenly applied to the line, wherein the resistance to stretching of the line increases as the amount of Stretch of the line increases. The ball is rotated in a circular pattern about the handle by the user. The ball is spaced apart from the handle by a critical safe distance of between about six feet and about 11½ feet to enable the aid to be used in a safe and yet controlled manner according to the inventive method.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein.

BEST MODE FOR CARRYING OUT THE INVENTION

Figure 1:
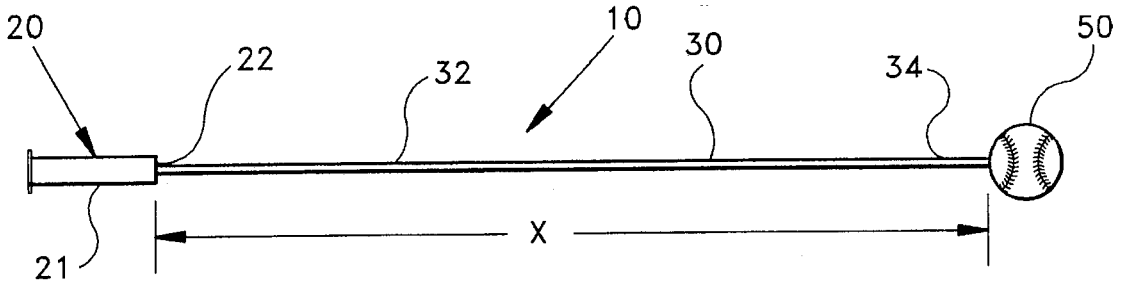
FIG. 1 is a plan view of a batting practice aid, which is constructed in accordance with the present invention.
Figure 3:
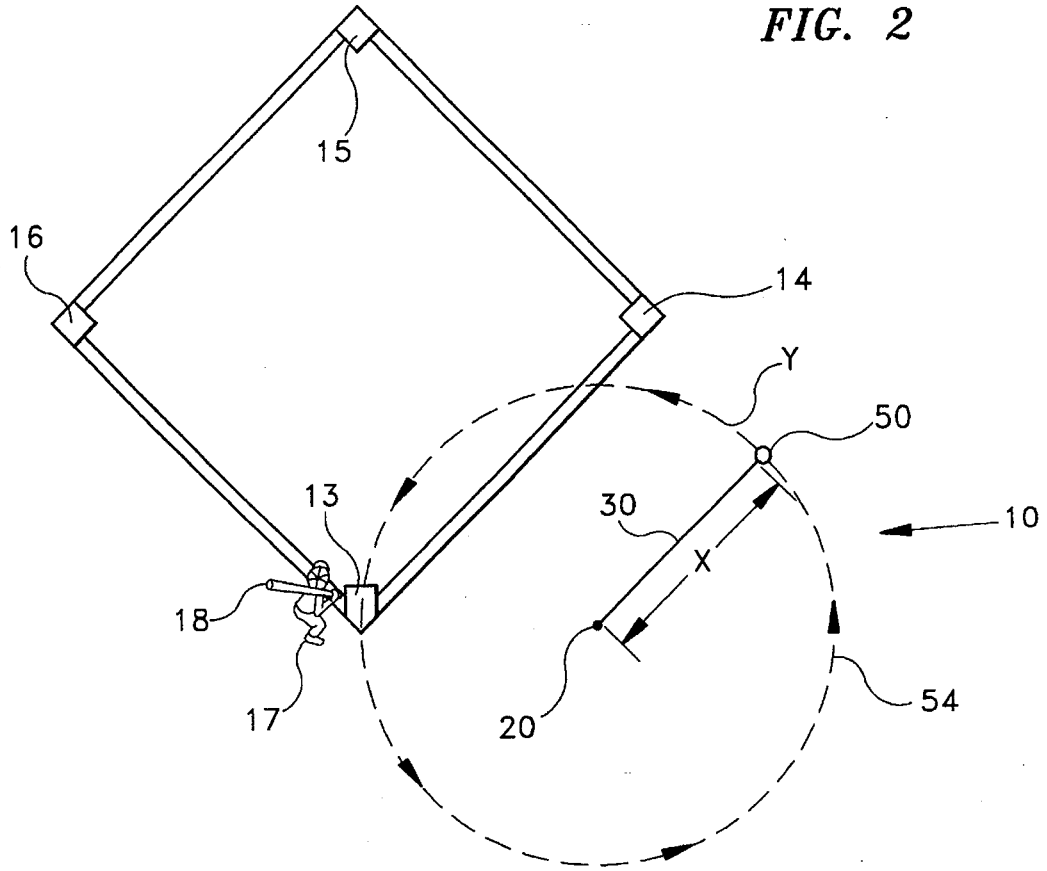
FIG. 3 is a diagrammatical plan view of the batting practice aid of FIG. 1 illustrated in use with a batter.

Referring now to the drawings, and more particularly to FIGS. 1 and 3 thereof, there is shown a batting practice aid 10 which is constructed according to the present invention. The aid 10 is intended for use by a user or thrower (not shown) who serves as a batting practice pitcher to provide a batter 17 (FIG. 3) gripping a bat 18 with batting practice to develop hand and eye coordination skills and to adjust or correct the batting swing. The aid 10 can be used in conjunction with a baseball diamond 12 having a first base 14, a second base 15, a third base 16 and a home plate 13 to provide a baseball game environment. While the aid 10 is shown and described to be used in connection with the game of baseball, it will become apparent to those skilled in the art that the aid 10 may also be used in connection with other ball hitting games.

The aid 10 generally includes a handle 20 having an impact absorbing line 30 attached to one end 32 thereof. A ball 50 is secured to the other end 34 of the line 30 to provide a target for the batter 17. As described hereinafter in greater detail, in accordance with the present invention, the line 30 has a critical length X which is sufficient to permit the user to stand a safe distance away from the batter 17 swinging a bat, and yet it is sufficiently short to enable the user to control effectively the movement of the ball in a circular orbit over the head of the user. The ball 50 is a simulated baseball, but the ball 50 is composed of soft elastomeric material for safety purposes.

In operation, the user stands to the right side of the batter 17 opposite the home plate 13, wherein the right handed batter 17 generally faces the user. The user grasps the handle 20 with one hand only and manipulates the handle 20 to cause the ball 50 to rotate about the handle 20 along a continuous, circular closed loop path of travel as restrained by the line 30. Preferably, the ball 50 is made to rotate repeatedly in a generally circular path 52 above the head of the user. The path 52 is controlled to pass over the home plate 13 near the batter 17.

The ball 50 is rotated in a generally counter-clockwise direction for right handed batters, such as the batter 17, to permit the ball 50 to move toward the batter 17 from the front. Similarly, the ball 50 would be rotated in a clockwise direction for a left handed batter (not shown), and the user would be positioned to the left of home plate 13 to enable the batter to face the thrower.

A strike zone (not shown) is associated with the batter 17 and is indicative of an area wherein the batter 17 should attempt to contact the ball 50 or incur a penalty of a strike in accordance with the rules of baseball. The user controls the speed at which the ball 50 rotates about the handle 20 and also controls the height of the ball travel path 52 above the ground to provide the batter 17 with a variety of pitches. The angle at which the ball 50 crosses the base 13 can also be varied by the user to further help develop the hand and eye coordination skills of the batter 17.

Considering now the handle 20 in greater detail with reference to FIG. 1, the handle 20 includes an end portion 22 and a hand grippable portion 21 which can be grasped easily by one hand of the user, wherein the user can manipulate the handle 20 without exerting a large quantity of energy. The handle 20 is preferably made of strong and light weight rigid material, such as wood or a thermoplastic material. The end of the line 30 can be fastened to the handle 20 by any conventional technique.

Figure 2:
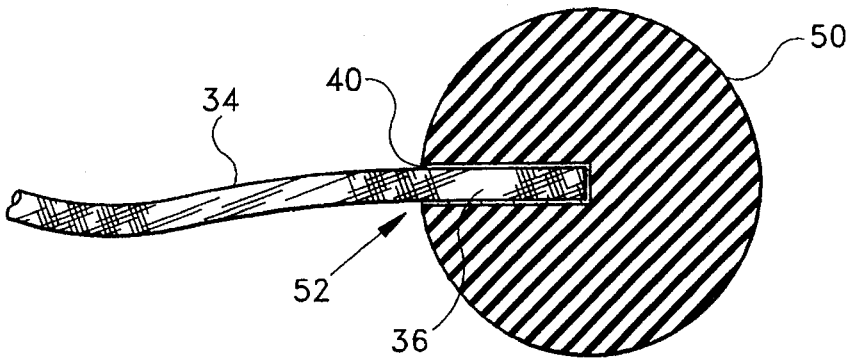
FIG. 2 is an enlarged partial cross-sectional, fragmentary view of the batting practice aid of FIG. 1.

Considering now the line 30 in greater detail with reference to FIGS. 1-3, the line 30 includes end portions 32 and 34 connected to the handle 20 and the ball 50, respectively. The end portion 32 is attached fixedly to the handle end portion 22 to permit the line 30 to restrain the ball as it rotates about the handle 20 and tether it thereto. Alternatively, the end portion 32 could be rotatably secured to the handle 20 by a conventional ball bearing mechanism (not shown), and still provide the desired control.

In accordance with the present invention, the line 30 is preferably composed of an elastic woven cord, such as bungee cord material, to enable the line 30 to stretch along its length yet resist the stretching and return to its original length. In this manner, the line 30 can absorb sudden outward tension forces applied to the line 30, such as when the bat 18 makes contact with either the ball 50 or the line 30, thereby serving as a shock absorber for protecting the user from experiencing severe impacts or jolts during use of the aid. To absorb the sudden impact resulting from the tension forces, the resistance of the line 30 to stretching increases as the amount of stretch or elongated deformation of the line 30 increases. As a result, the outward tension forces caused by the bat hitting the line or the ball, are gradually reduced as the line 30 stretches, thereby absorbing the impact and lessening the likelihood of injury to the user or to the batter 17.

According to the present invention, a certain critical distance or length X of the line 30 is employed to provide the user with effective control over the rotating ball 50, and still permit the user to stand sufficiently far away from the batter 17 and be safe from the batter swinging the bat. In this regard, the critical length X of the line 30 is between about six feet and about 11½ feet.

According to the inventive method of using the aid 10 as indicated in FIG. 3, the user stands the critical distance X away from the batter. At this critical distance, the user can control the ball 50 as it orbits repeatedly over the head of the user and into the strike zone of the batter 17, and yet the user is protected against injury.

When the line length X is equal to six feet, a small or young user of the aid 10 can control the orbiting of the ball 50 and directing it repeatedly into the strike zone area of the batter 17. While standing only six feet away from the user, the user is safe from injury from being hit by the ball 50 being hit directly toward the user, since the ball 50 is composed of safe elastomeric material.

When the line length X is equal to 11½ feet, the user stands about 11½ feet away from the batter 17. At that distance, the user is safe from being hit by the batted ball 50, since the user can use evasive maneuvers to avoid being hit. Also, it has been discovered at the critical distance of 11½ feet, the user is able to control the movement of the ball 50 as it orbits repeatedly. The speed and distance can be controlled without undue tiring of the user.

In general, the height of the user determines the specific distance X for the length of line and the distance from the batter. The length X of the line is proportional to the height of the user.

The most preferable length X of the line 30 is between about seven feet and about eleven feet.

Considering now the ball 50 in greater detail with reference to FIG. 2, the ball 50 is preferably composed of a resilient elastomeric material. The ball 50 includes an opening 52 to help secure the line 30 thereto. The opening 52 is sized to receive an insert portion 36 integrally connected to end portion 36. The insert portion 36 is generally straight and knotless to reduce the length of insert portion 36, thereby reducing the overall cost of the aid 10.

The insert portion 36 is coated with a suitable adhesive and inserted into the opening 52, wherein the adhesive forms an adhesive layer 40 surrounding the insert portion 36 to help secure the insert portion 36 within the opening 52. Alternatively, the adhesive can be injected into the opening 52 and the insert portion 36 inserted therein. The securing of the insert portion 36 is enhanced by the adhesive filling the gaps (not shown) of the woven material of the insert portion 36.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A batting practice aid which comprises:

a line formed from an elastic "bungee" cord material capable of stretching significantly in response to an elongating force and returning to original length upon removal of said elongating force;

a ball formed from soft elastomeric material having a radial hole extending into said ball a distance at least generally equal to the radius of said ball;

a first end of said line inserted into said hole and secured thereto by an adhesive layer filling interstices in said line and bonding to walls of said radial hole;

a generally cylindrical handle sized to be held in one hand of a user, said handle having an axial hole in one end;

a second end of said line inserted into said axial hole and secured therein;

whereby said handle may be held by a user and the ball and line swung in a circular path so that the ball moves past a batter who may strike the ball with a bat, causing said ball to move away from the batter and said line to stretch and absorb energy, reducing forces on said line-to-ball and handle-to-line connections, then elastically return to the original line length.

2. The batting practice aid according to claim 1 wherein said line has a length of from about 6 and 11.5 feet.

* * * * *